US008997881B2

(12) United States Patent
Ringgenberg et al.

(10) Patent No.: US 8,997,881 B2
(45) Date of Patent: Apr. 7, 2015

(54) PRESSURE BEARING WALL AND SUPPORT STRUCTURE THEREFOR

(75) Inventors: Paul D. Ringgenberg, Frisco, TX (US); Adam H. Martin, Dallas, TX (US); Donald Perkins, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 635 days.

(21) Appl. No.: 12/903,648

(22) Filed: Oct. 13, 2010

(65) Prior Publication Data

US 2012/0090854 A1 Apr. 19, 2012

(51) Int. Cl.
*E21B 23/00* (2006.01)
*E21B 17/00* (2006.01)
*E21B 41/00* (2006.01)

(52) U.S. Cl.
CPC ..... *E21B 17/00* (2013.01); *E21B 23/00* (2013.01); *E21B 41/00* (2013.01)

(58) Field of Classification Search
CPC ..... E21B 17/00; E21B 41/00; E21B 23/00
USPC ..... 166/373, 319, 370, 386, 242.1, 202, 166/141, 147, 164, 284, 152, 187, 382; 138/42
See application file for complete search history.

(56) References Cited

U.S. PATENT DOCUMENTS 2,390,372 A 12/1945 Johnston et al.
2,392,777 A 1/1946 Schultze
2,935,615 A 5/1960 True
3,614,988 A * 10/1971 Moore ..... 166/193
4,098,338 A 7/1978 Perkins
4,298,078 A 11/1981 Lawrence
4,871,179 A 10/1989 Bell et al.
5,316,094 A 5/1994 Pringle
5,337,827 A 8/1994 Hromas et al.
5,819,353 A 10/1998 Armell et al.
5,893,413 A 4/1999 Lembcke et al.

(Continued)

FOREIGN PATENT DOCUMENTS

EP 0584381 A1 2/1994
GB 2410759 B 10/2005

OTHER PUBLICATIONS

H. Hamrin, Guide to Under Ground Mining Methods and Applications, dated 2007, 1 page.

(Continued)

*Primary Examiner* — Yong-Suk (Philip) Ro
(74) *Attorney, Agent, or Firm* — Chamberlain Hrdlicka

(57) ABSTRACT

A method of supporting a pressure bearing wall against a pressure differential applied across the wall can include positioning a support structure proximate the pressure bearing wall, the support structure having a support surface formed thereon, and the support surface contacting the pressure bearing wall and supporting the wall against the pressure differential. A pressure bearing housing assembly can include a pressure bearing wall and a support structure which supports the pressure bearing wall against a pressure differential applied across the wall. A well system can comprise a well tool including a pressure bearing housing assembly exposed to pressure in a wellbore, whereby a pressure differential is applied across a pressure bearing wall of the housing assembly, the pressure bearing wall being supported against the pressure differential by a support structure.

23 Claims, 6 Drawing Sheets

(56) References Cited

U.S. PATENT DOCUMENTS

| | | | | |
|---|---|---|---|---|
| 6,019,583 | A | 2/2000 | Wood | |
| 6,253,857 | B1 | 7/2001 | Gano | |
| 6,547,011 | B2 * | 4/2003 | Kilgore | 166/387 |
| 6,575,239 | B2 | 6/2003 | Allen | |
| 7,396,220 | B2 | 7/2008 | Delpassand et al. | |
| 8,171,999 | B2 * | 5/2012 | Langeslag | 166/373 |
| 8,376,053 | B2 * | 2/2013 | Obrejanu | 166/369 |
| 2005/0000692 | A1 * | 1/2005 | Cook et al. | 166/300 |
| 2007/0007014 | A1 | 1/2007 | Sessions et al. | |
| 2009/0139708 | A1 | 6/2009 | Foster | |

OTHER PUBLICATIONS

Great Britain International Preliminary Report on Patentability issued Apr. 25, 2013 for PCT Patent Application No. PCT/GB2011/001476, 10 pages.

International Search Report and Written Opinion issued Mar. 25, 2013 for PCT Patent Application No. PCT/GB2011/001476, 11 pages.

* cited by examiner

PRESSURE BEARING WALL AND SUPPORT STRUCTURE THEREFOR

BACKGROUND

This disclosure relates generally to pressure bearing housing assemblies and, in an example described below, more particularly provides a pressure bearing wall and a support structure for the wall.

Very high pressures can be experienced by well tools installed in deep wellbores. In addition, space is limited in such wellbores, and so it is not always practical to increase wall thickness in order to increase a pressure bearing capability of a wall in a well tool. The space limitations could be due to, for example, a need for a certain maximum outer diameter (e.g., to fit inside a particular casing size) and/or minimum inner diameter (e.g., to provide a minimum flow area) for a well tool.

Therefore, it will be appreciated that improvements are needed in the art of increasing the pressure bearing capabilities of walls in pressurized environments. Such improvements could be useful in well tools, and in other types of pressure bearing devices.

SUMMARY

In the disclosure below, a housing assembly of a well tool is described as an example of improvements provided to the art of constructing pressure bearing walls. In this example, at least one support structure is used to support a pressure bearing wall. The support structure can have a variety of shapes.

In one aspect, the disclosure below provides to the art a well system which can include a well tool including a pressure bearing housing assembly exposed to pressure in a wellbore, whereby a pressure differential is applied across a pressure bearing wall of the housing assembly. The pressure bearing wall is supported against the pressure differential by a support structure.

In another aspect, the present disclosure provides a pressure bearing housing assembly. The assembly can include a pressure bearing wall and a support structure which supports the pressure bearing wall against a pressure differential applied across the wall.

In yet another aspect, a method of supporting a pressure bearing wall against a pressure differential applied across the wall is provided. The method can include positioning a support structure proximate the pressure bearing wall, the support structure having a support surface formed thereon; and the support surface contacting the pressure bearing wall and supporting the wall against the pressure differential.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
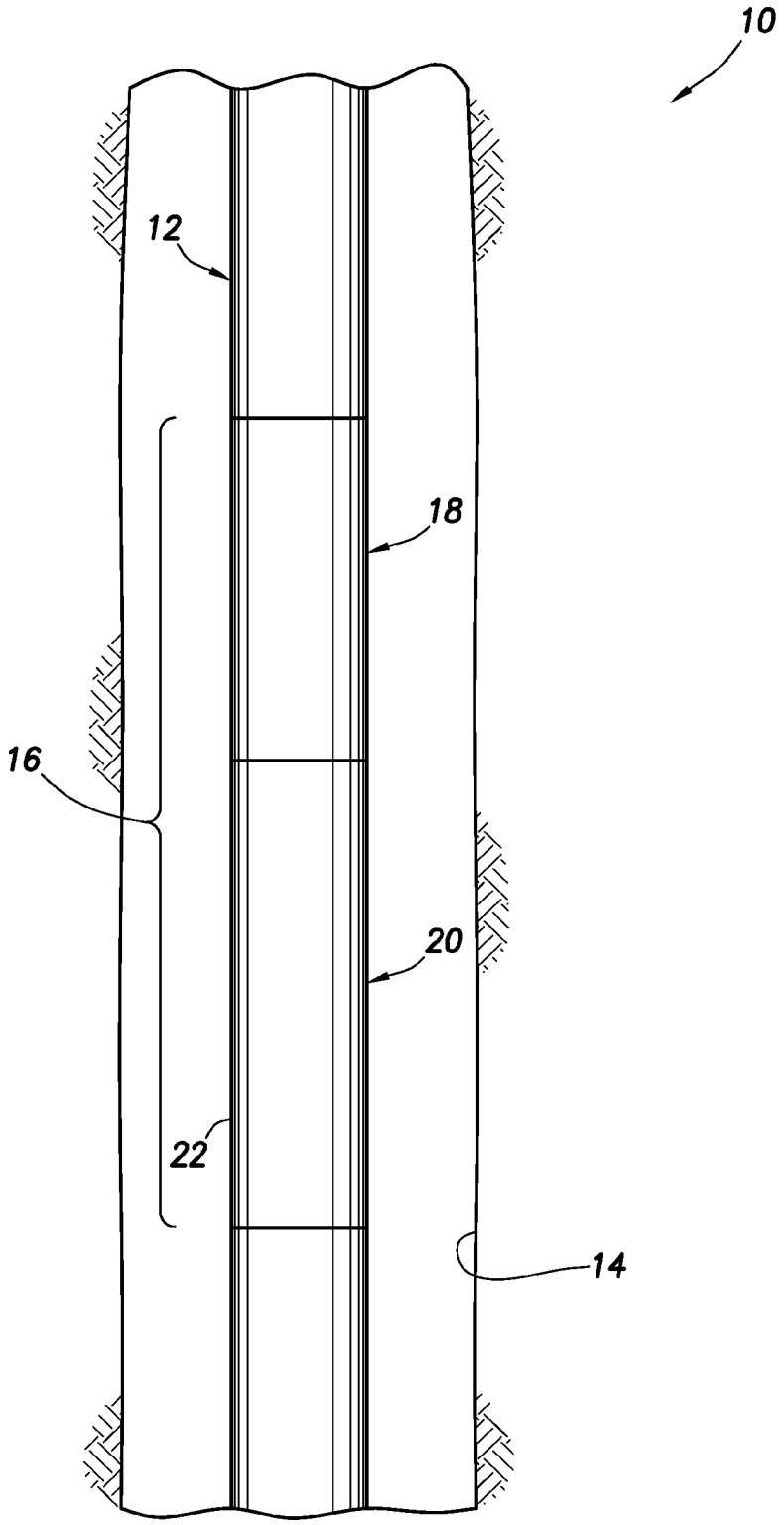
FIG. 1 is a schematic partially cross-sectional view of a well system and associated method which can embody principles of the present disclosure.

Representatively illustrated in FIG. 1 is a well system 10 and associated method which can embody principles of this disclosure. In the example of FIG. 1, a tubular string 12 has been installed in a wellbore 14. The tubular string 12 includes a tool assembly 16 comprising well tools 18, 20.

At this point, it should be noted that the well system 10 is merely one example of a wide variety of well systems which can incorporate principles of this disclosure. Thus, the details of the well system 10 described herein are not to be taken as limiting those principles. For example, the wellbore 14 could be cased or uncased, the well tools 18, 20 are not necessarily used together or as part of the tool assembly 16, and are not necessarily interconnected in the tubular string 12, etc.

In the example of FIG. 1, the well tool 18 comprises a well testing valve and the well tool 20 comprises a low pressure (e.g., atmospheric pressure) chamber used to provide a pressure differential for actuating the valve. However, the principles of this disclosure can be used with other types of well tools, and with other pressure bearing structures, housings, etc.

It will be appreciated that external pressure is applied to the well tool 20 due, for example, to hydrostatic pressure in the wellbore 14, plus any pressure applied to the wellbore, etc. For this reason (and others), the well tool 20 includes a pressure bearing housing assembly 22.

Figure 2:
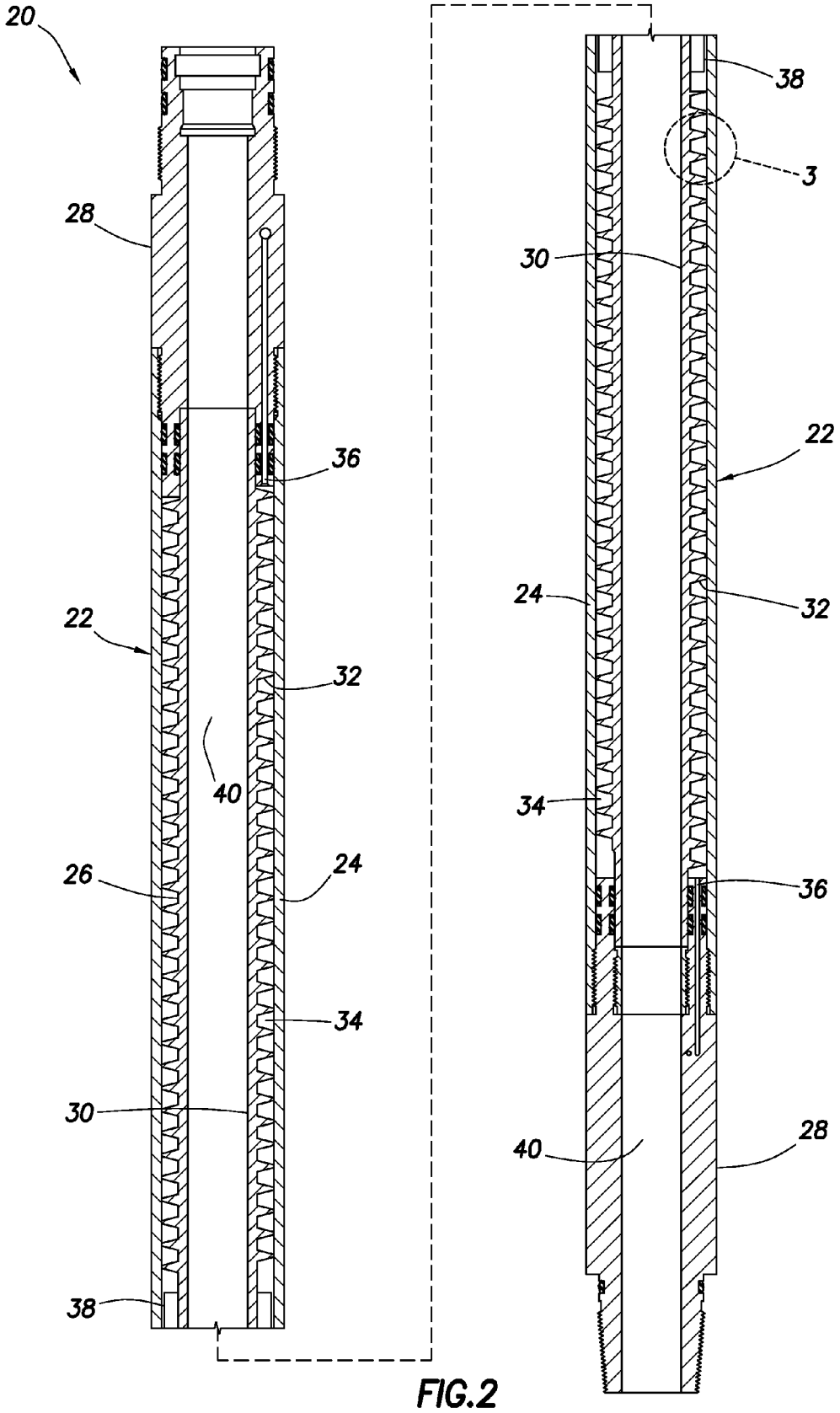
FIG. 2 is a schematic enlarged scale cross-sectional view of a housing assembly of a well tool which may be used in the well system and method of FIG. 1.

A cross-sectional view of the well tool 20 is representatively illustrated in FIG. 2. In this view it may be seen that the housing assembly 22 includes an outer generally tubular shaped pressure bearing wall 24 and an inner support structure 26. Threaded end adaptors 28 join the ends of the pressure bearing wall 24 and seal against opposite ends of the structure 26, and provide for interconnecting the well tool 20 in the tubular string 12. Preferably, the support structure 26 is free floating between the end adaptors 28, allowing for thermal expansion during operation, and making maintenance/cleaning of the housing assembly 22 more convenient.

The support structure 26 depicted in FIG. 2 includes a generally tubular base 30, with one or more helically formed supports 32 extending radially outward from the base. In one important feature of the FIG. 2 housing assembly 22, a helical fluid chamber 34 extends between the supports 32, so that a fluid volume is provided between the adaptors 28 (e.g., between ports 36 in the adaptors) via the fluid chamber. Preferably, fluid communication between the ports 36 is provided by the chamber 34.

In another important feature of the FIG. 2 housing assembly 22, the supports 32 radially outwardly support the pressure bearing wall 24 against a pressure differential applied across the wall. The helical supports 32 provide continual radial support of the wall 24. This support allows the wall 24 to be made thinner for a given pressure differential, providing more internal volume in the housing assembly 22, thereby allowing the well tool 20 to be shorter in length than would otherwise be required (e.g., to achieve a particular internal volume). Furthermore, the outer diameter of the housing assembly 22 is reduced, allowing the housing assembly to be installed in smaller diameter casings.

In the example of FIG. 2, two of the helical supports 32 are provided on the base 30, with one on each end of the base, for manufacturing reasons, but a single helical support or any other number of supports may be used as desired. A generally cylindrical, longitudinally-slotted support 38 is provided between the two helical supports 32 for supporting the wall 24 between the helical supports.

A flow passage 40 extends longitudinally through the adaptors 28 and support base 30. This flow passage 40 also extends through the tubular string 12 when the well tool 20 is interconnected as part of the tubular string.

It will be appreciated that, as external pressure applied to the wall 24 increases, the wall is increasingly deflected inward. At a certain level, the pressure differential applied across the wall 24 would collapse the wall inward, if not for the presence of the support structure 26 therein. The support structure 26 radially outwardly supports the wall 24, so that inward collapse of the wall is resisted.

Figure 3B:
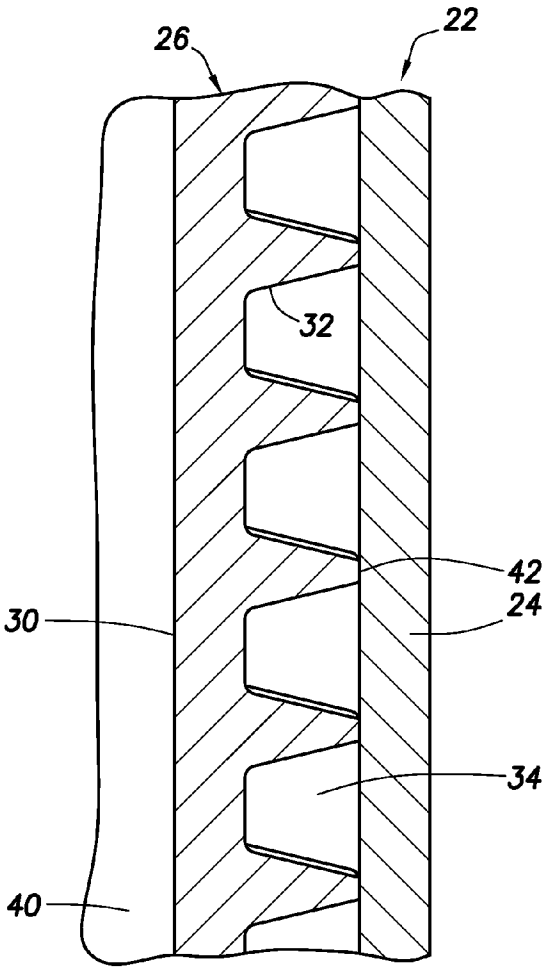
FIGS. 3A & B are further enlarged scale schematic cross-sectional views of a portion of the housing assembly, with the housing assembly being depicted at a reduced applied pressure differential in FIG. 3A, and with the housing assembly being depicted at an increased applied pressure differential in FIG. 3B.
Figure 3A:
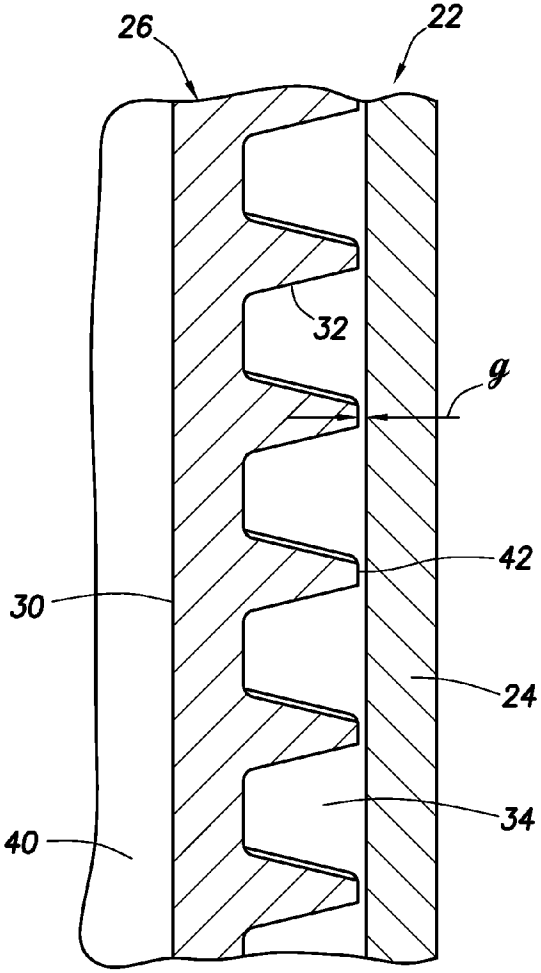

Referring additionally to FIGS. 3A & B, an enlarged scale cross-sectional view of a portion of the housing assembly 22 is representatively illustrated. FIG. 3A depicts the housing assembly 22 when the pressure differential across the wall 24 is less than a predetermined level, and FIG. 3B depicts the housing assembly when the pressure differential across the wall is greater than the predetermined level.

Note that, in FIG. 3A, a helical support surface 42 formed on the support 32 is radially spaced apart from the wall 24. A gap g is visible between the support surface 42 and the wall 24. Thus, when the pressure differential across the wall 24 is less than the predetermined level (e.g., when the well tool 20 is at the surface, etc.), there is no contact between the support 32 and the wall, thereby enabling the housing assembly 22 to be conveniently assembled, disassembled, etc.

However, in FIG. 3B, the wall 24 has deflected radially inward somewhat, so that the gap g is eliminated, and the support 32 contacts and radially outwardly supports the wall. Thus, when the pressure differential across the wall 24 is greater than the predetermined level (e.g., when the well tool 20 is subjected to hydrostatic pressure and/or other applied pressure, etc.), there is contact between the support 32 and the wall, thereby enabling the wall to withstand the increased pressure differential without collapsing.

Note that it is not necessary for the gap g to be present between the support surface 42 and the wall 24 at the reduced pressure differential of FIG. 3A, in keeping with the principles of this disclosure. In other examples, the support surface 42 could be in contact with the wall 24 at reduced pressure differentials.

In each of the situations represented by FIGS. 3A & B, fluid flow through the chamber 34 is permitted. Thus, the well tool 20 is usable as a reduced pressure fluid volume (e.g., an atmospheric chamber, etc.) whether or not the pressure differential is above the predetermined level. Preferably, fluid flow through the chamber 34 is permitted within the housing assembly 22 and, in one preferred example, fluid flow may be permitted between the chamber and one or more other assemblies via at least one port 36 of the end adaptors 28.

Figure 4B:
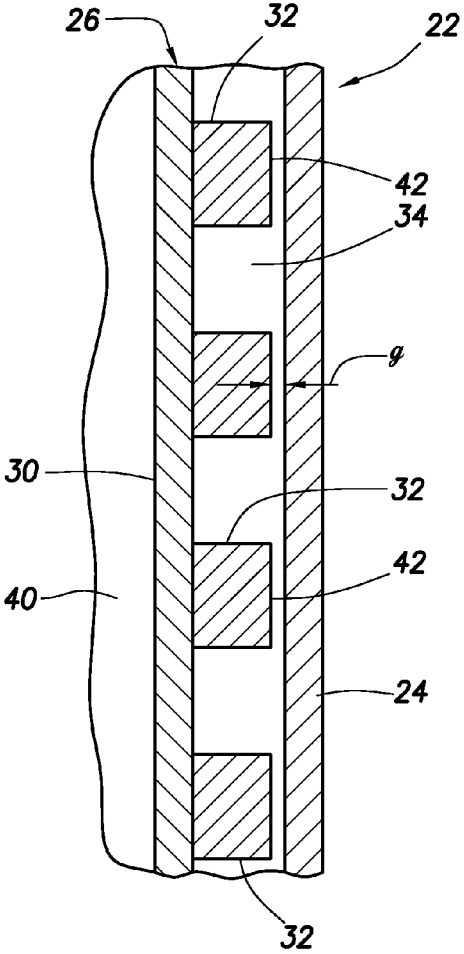
FIGS. 4A & B are schematic elevational and cross-sectional views of another configuration of the housing assembly.
Figure 4A:
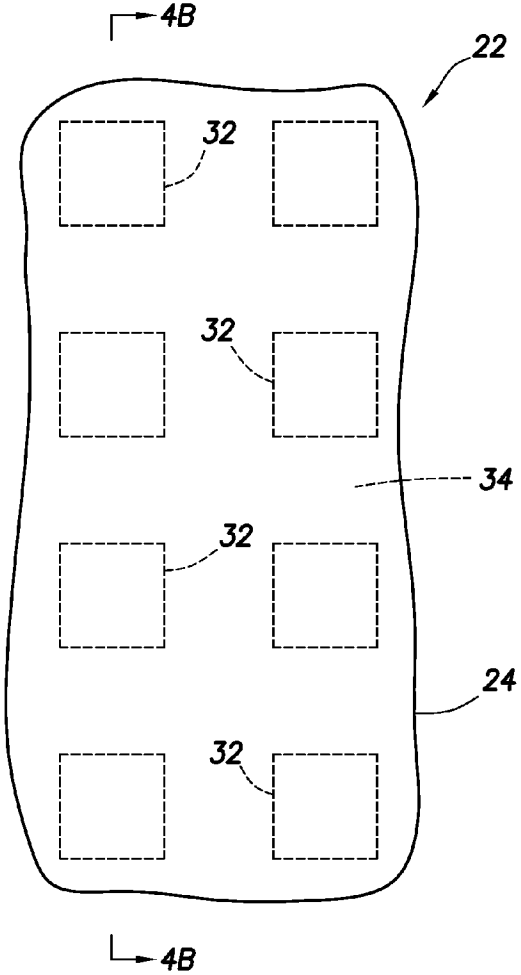

Referring additionally now to FIGS. 4A & B, another configuration of the housing assembly 22 is representatively illustrated. In this configuration, the supports 32 are not helically shaped, but are instead pillars or columns extending radially outward from the base 30. The chamber 34 extends circumferentially and longitudinally between the supports 32.

Figure 5B:
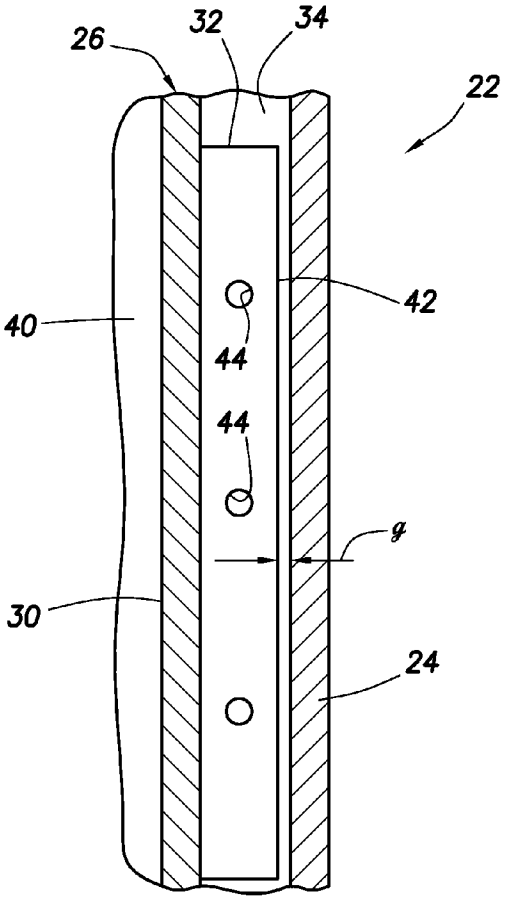
FIGS. 5A & B are schematic elevational and cross-sectional views of yet another configuration of the housing assembly.
Figure 5A:
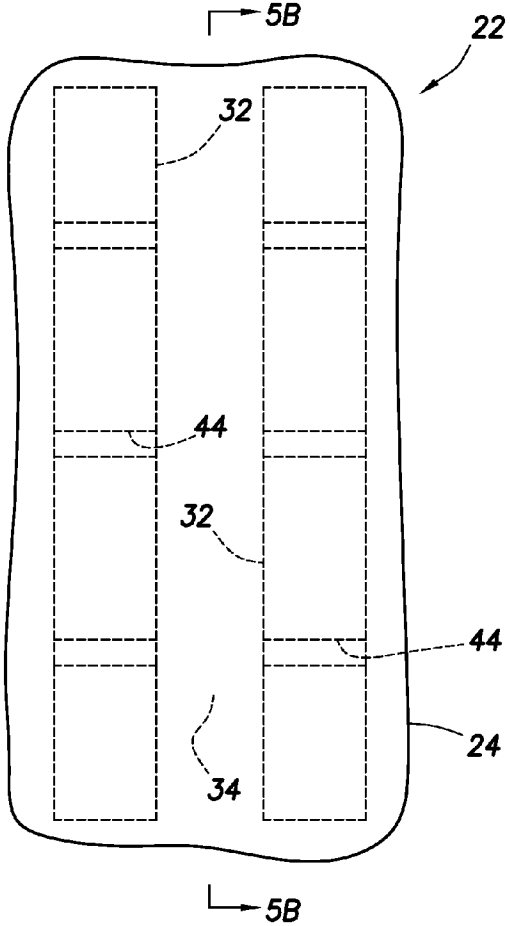

Referring additionally now to FIGS. 5A & B, another configuration of the housing assembly 22 is representatively illustrated. In this configuration, the supports 32 are longitudinally elongated, with the chamber 34 extending between the supports. Openings 44 may be provided to allow for fluid communication through the supports 32.

Figure 6B:
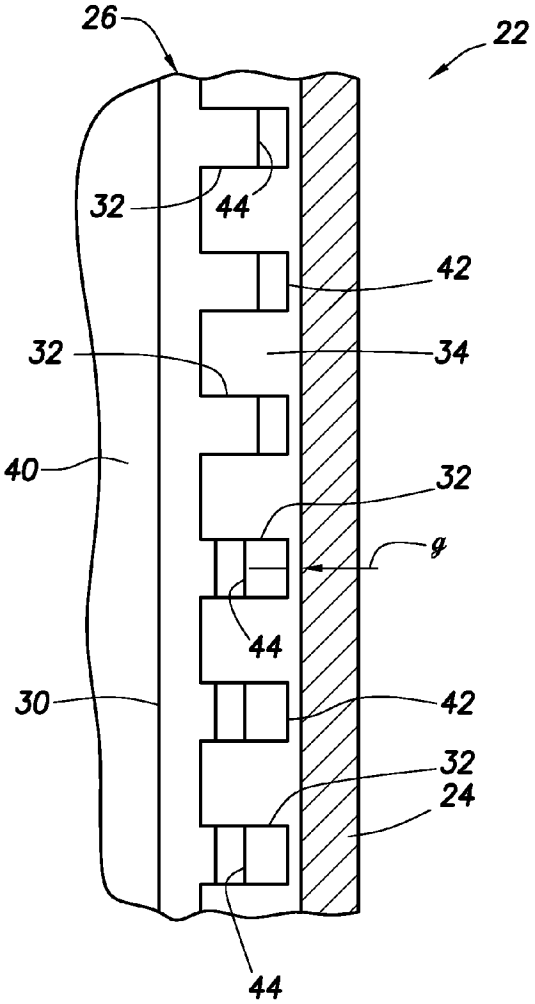
FIGS. 6A & B are schematic elevational and cross-sectional views of a further configuration of the housing assembly.
Figure 6A:
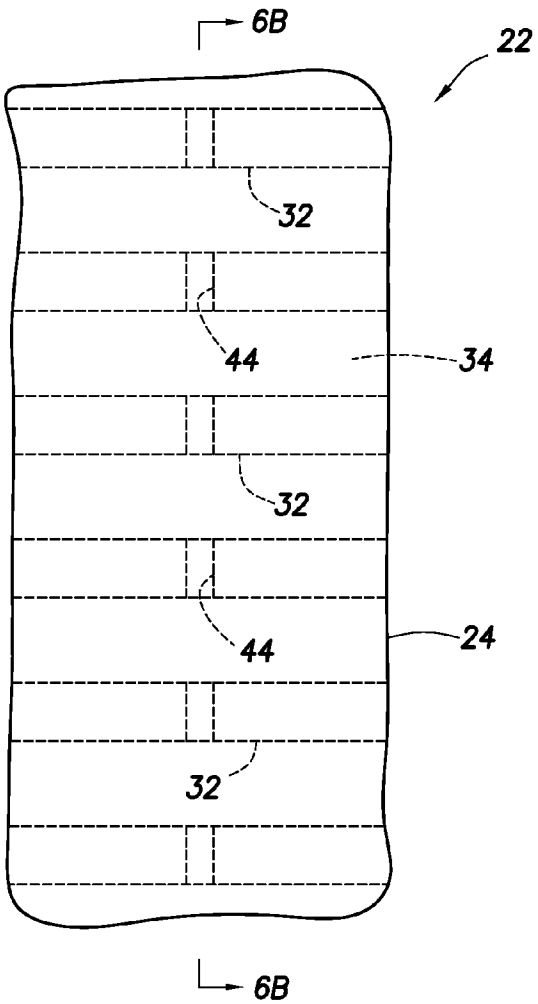

Referring additionally now to FIGS. 6A & B, another configuration of the housing assembly 22 is representatively illustrated. In this configuration, the supports 32 are longitudinally spaced apart and extend circumferentially about the base 30. The chamber 34 extends circumferentially between each adjacent pair of the supports 32, with openings 44 providing fluid communication through the supports.

The supports 38 of FIG. 2, and the supports 32 of FIGS. 4A-6B demonstrate that it is not necessary for the supports to be helically shaped. It is also not necessary for the chamber 34 extending in the support structure 26 to be helically shaped.

Note that internal pressure applied to the flow passage 40 could cause the gap g to decrease, due to outward deformation of the base 30. In addition, internal pressure applied to the chamber 34 could cause the gap g to increase, due to inward deformation of the base 30 and/or outward deformation of the wall 24. In any event, the supports 32, 38 can still resist inward deformation of the wall 24 when the support surface 42 contacts the wall.

Preferably, for use in the well system 10, dimensions and materials of the supports 32, 38, base 30, wall 24 and support surface 42 are optimized, so that the supported wall can resist an expected pressure differential across the wall in the well, while a ratio of chamber 34 volume/housing assembly 22 length is maximized. In other examples, it may be desired to maximize the pressure differential resisting capability of the supported wall 24, minimize the outer diameter of the housing assembly 22, maximize the inner diameter of the base 30, etc.

Although the wall 24 is depicted in the drawings and is described above as being external to the support structure 26, it will be appreciated that these positions could be reversed. In that case, internal pressure applied to the wall 24 could cause it to deflect radially outward, and the support structure 26 could operate to prevent rupturing of the wall.

It may now be fully appreciated that the above disclosure provides several improvements to the art of constructing pressure bearing housing assemblies. These improvements are very useful in well tools intended for installation in wells, but the improvements can also be useful in other applications, industries, etc., such as medical implant devices, pressure vessels used at the surface or subsea, etc.

The above disclosure provides to the art a well system 10 which can include a well tool 20 including a pressure bearing housing assembly 22 exposed to pressure in a wellbore 14, whereby a pressure differential is applied across a pressure bearing wall 24 of the housing assembly 22. The pressure bearing wall 24 is supported against the pressure differential by a support structure 26.

The support structure 26 may be helically shaped.

The support structure 26 may comprise a helically extending support surface 42 spaced apart from a base 30 of the support structure 26. The support surface 42 can contact the pressure bearing wall 24 in response to the pressure differential being greater than a predetermined level. The support surface 42 may contact the pressure bearing wall 24 only when the pressure differential is greater than the predetermined level.

A fluid chamber 34 may extend through the support structure 26. Fluid can flow through the chamber 34 while the support structure 26 supports the pressure bearing wall 24 against the pressure differential. The fluid chamber 34 may extend helically through the support structure 26.

The pressure bearing wall 24 may be generally tubular shaped. The support structure 26 may be generally tubular shaped, and may be positioned internal to the pressure bearing wall 24.

Also described in the above disclosure is a pressure bearing housing assembly 22 which can include a pressure bearing wall 24 and a support structure 26 which supports the pressure bearing wall 24 against a pressure differential applied across the wall 24.

The above disclosure also provides to the art a method of supporting a pressure bearing wall 24 against a pressure differential applied across the wall 24. The method can include positioning a support structure 26 proximate the pressure bearing wall 24, with the support structure 26 having a support surface 42 formed thereon; and the support surface 42 contacting the pressure bearing wall 24 and supporting the wall 24 against the pressure differential.

The method may also include applying the pressure differential across the pressure bearing wall 24 at least in part by installing the pressure bearing wall 24 and support structure 26 in a wellbore 14.

The support surface 42 may not contact the pressure bearing wall 24 when the pressure differential is less than a predetermined level. The support surface 42 may contact the pressure bearing wall 24 only when the pressure differential is greater than the predetermined level.

The method may include flowing fluid into a fluid chamber 34 of the support structure 26. The fluid flowing step may be performed after the support surface 42 contacts and supports the pressure bearing wall 24.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system for a wellbore, comprising:

a well tool including a pressure bearing housing assembly comprising:

an outer wall surrounding an interior;

an inner support structure in the interior of the outer wall and including a base spaced radially inward from the outer wall and a support extending radially outward from the base, the base including a flow passage therethrough; and a fluid chamber located between the outer wall and the base; and wherein the inner support structure configured to radially outwardly support the outer wall against a pressure differential that would otherwise inwardly collapse of the outer wall.

2. The well system of claim 1, wherein the outer wall is spaced apart from the inner support structure so as to only come into contact with the support upon being subjected to a pressure differential increase.

3. The well system of claim 1, wherein the support is helically shaped.

4. The well system of claim 1, wherein the fluid chamber extends along the entire support.

5. The well system of claim 4, wherein fluid may flow through the fluid chamber while the inner support structure is supporting the pressure bearing wall against the pressure differential.

6. The well system of claim 1, wherein the pressure bearing wall is generally tubular shaped, and wherein the base is generally tubular shaped.

7. The well system of claim 1, the well tool further comprising a fluid channel through the well tool that includes the flow passage of the base.

8. The well system of claim 1, wherein the inner support structure allows the outer wall to be made thinner for a given pressure differential across the outer wall.

9. The well system of claim 1, where in the inner support structure allows the outer diameter of the housing assembly to be reduced for a given pressure differential across the outer wall.

10. The well system of claim 1, wherein the inner support structure is capable of providing continual radially outward support to the outer wall.

11. The well system of claim 1, further comprising:

the pressure bearing housing assembly further comprising a channel in communication with the fluid chamber; and wherein fluid is capable of flowing into or out of the fluid chamber via the channel.

12. The well system of claim 1, wherein the dimensions and materials of the outer wall and the inner support structure are optimized so that the outer wall can resist an expected pressure differential across the outer wall in the wellbore, while a ratio of the fluid chamber volume to pressure bearing housing assembly length is maximized.

13. A pressure bearing housing assembly, comprising:

a pressure bearing wall surrounding an interior;

a support structure in the interior of the wall and including a flow passage therethrough;

a fluid chamber formed between the support structure and the wall; and wherein the inner support structure configured to radially outwardly support the outer wall against a pressure differential that would otherwise inwardly collapse of the outer wall.

14. The pressure bearing housing assembly of claim 13, wherein the support structure comprises:

a base; and a helically extending support extending radially out from the base of the support structure.

15. The pressure bearing housing assembly of claim 14, wherein the wall is spaced apart from the support structure so as to only come into contact with the support upon being subjected to a pressure differential increase.

16. The pressure bearing housing assembly of claim 14, wherein the fluid chamber extends along the entire support.

17. The pressure bearing housing assembly of claim 16, wherein fluid may flow through the fluid chamber while the support structure supports the pressure bearing wall against the pressure differential.

18. The pressure bearing housing assembly of claim 13, wherein the pressure bearing wall is generally tubular shaped, and wherein the support structure is generally tubular shaped and is positioned internal to the pressure bearing wall.

19. A method of supporting a pressure bearing wall, the method comprising:

positioning a support structure inside of the pressure bearing wall, the support structure comprising a support for radially outwardly supporting less than the full surface area of the interior of the pressure bearin wall thereb formin a fluid chamber between the pressure bearing wall and the support structure;

subjecting the pressure bearing wall against a pressure differential across the wall; and supporting the pressure bearing wall with the support structure against a pressure differential that would otherwise inwardly collapse of the pressure bearing wall.

20. The method of claim 19, further comprising subjecting the pressure bearing wall to the pressure differential by placing the pressure bearing wall and support structure in a wellbore.

21. The method of claim 19, wherein the support surface does not contact the pressure bearing wall when the pressure differential is less than a predetermined level.

22. The method of claim 19, further comprising flowing fluid into the fluid chamber.

23. The method of claim 19, wherein the support structure is helically shaped.

* * * * *

UNITED STATES PATENT AND TRADEMARK OFFICE

CERTIFICATE OF CORRECTION

PATENT NO. : 8,997,881 B2
APPLICATION NO. : 12/903648
DATED : April 7, 2015
INVENTOR(S) : Paul D. Ringgenberg et al.

It is certified that error appears in the above-identified patent and that said Letters Patent is hereby corrected as shown below:

In the Claims

Column 6, line 52, "the base of the support structure" should read -- the base --.

Column 7, line 4, "pressure bearin wall thereb" should read -- pressure bearing wall, thereby --.

Signed and Sealed this
Twelfth Day of July, 2016

Michelle K. Lee

Michelle K. Lee
*Director of the United States Patent and Trademark Office*